US009425566B2

(12) United States Patent
Lee

(10) Patent No.: US 9,425,566 B2
(45) Date of Patent: Aug. 23, 2016

(54) POWER STRIP AND CORD THEREOF

(71) Applicant: POWERTECH INDUSTRIAL CO., LTD., New Taipei (TW)

(72) Inventor: Yu-Lung Lee, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 14/324,939

(22) Filed: Jul. 7, 2014

(65) Prior Publication Data

US 2015/0236459 A1 Aug. 20, 2015

(30) Foreign Application Priority Data

Feb. 19, 2014 (TW) ..... 103105478 A

(51) Int. Cl.

| | |
|---|---|
| ***H01R 25/00*** | (2006.01) |
| ***H01R 13/66*** | (2006.01) |
| *H01R 103/00* | (2006.01) |
| *H01R 24/20* | (2011.01) |

(52) U.S. Cl.

CPC ..... *H01R 25/003* (2013.01); *H01R 13/6675* (2013.01); *H01R 24/20* (2013.01); *H01R 2103/00* (2013.01)

(58) Field of Classification Search

USPC ..... 439/652, 131, 346; 361/115, 166

See application file for complete search history.

(56) References Cited

U.S. PATENT DOCUMENTS

| | | | | |
|---|---|---|---|---|
| 6,095,850 | A | 8/2000 | Liu | |
| 6,692,284 | B1 * | 2/2004 | Koh | 439/346 |
| 6,741,442 | B1 * | 5/2004 | McNally et al. | 361/166 |
| 7,254,005 | B2 * | 8/2007 | Oyama | 361/220 |
| 7,466,139 | B2 * | 12/2008 | Furukawa | 324/511 |
| 7,619,868 | B2 * | 11/2009 | Spitaels et al. | 361/115 |
| 7,658,625 | B2 * | 2/2010 | Jubelirer et al. | 439/131 |

(Continued)

FOREIGN PATENT DOCUMENTS

| | | |
|---|---|---|
| CN | 203056278 U | 7/2013 |
| EP | 0493080 A2 | 7/1992 |

(Continued)

OTHER PUBLICATIONS

Wang, "Plug With Meter", http://fandora.tw/item/4fd9a637517e023e5d00272d.

*Primary Examiner* — Alexander Gilman

(74) *Attorney, Agent, or Firm* — Li & Cai Intellectual Property (USA) Office

(57) ABSTRACT

A power strip adapted for receiving an alternating-current power includes a plug, a main body, and a cord connected there between. The plug includes at least two conductive pins and an output device. The main body includes at least one socket and a converting circuit. The cord includes an electrically insulating cover, and an alternating-current transferring wire and a direct-current transferring wire, which are wrapped in the electrically insulating cover. The alternating-current transferring wire is electrically connected between the conductive pins and the socket. The direct-current transferring wire is electrically connected between the output device and the converting circuit. The plug is for transferring the alternating-current power to the main body through the alternating-current transferring wire. The converting circuit is for converting the alternating-current power to a direct-current power and transferring the direct-current power to the output device through the direct-current transferring wire.

8 Claims, 6 Drawing Sheets

(56) References Cited

U.S. PATENT DOCUMENTS

| | | | | |
|---|---|---|---|---|
| 7,944,667 | B2 * | 5/2011 | Ouwerkerk | 361/106 |
| 8,000,074 | B2 * | 8/2011 | Jones et al. | 361/93.1 |
| 8,033,867 | B1 * | 10/2011 | Kessler et al. | 439/652 |
| 8,113,855 | B2 * | 2/2012 | Green et al. | 439/131 |
| 2007/0006603 | A1 * | 1/2007 | Reusche et al. | 62/196.4 |
| 2009/0191735 | A1 * | 7/2009 | Lin | 439/131 |
| 2009/0316321 | A1 | 12/2009 | Ouwerkerk | |
| 2011/0204849 | A1 * | 8/2011 | Mukai et al. | 320/111 |
| 2012/0112560 | A1 * | 5/2012 | Wu | 307/117 |

FOREIGN PATENT DOCUMENTS

| | | | |
|---|---|---|---|
| GB | 2450466 | A | 12/2008 |
| GB | 2480768 | A | 11/2011 |
| TW | M263665 | | 5/2005 |
| TW | M407524 | U1 | 7/2011 |

* cited by examiner

POWER STRIP AND CORD THEREOF

BACKGROUND

1. Field of the Invention

The instant disclosure relates to power strip and cord thereof, and pertains particularly to a power strip adapted for receiving alternating-current power and cord thereof.

2. Description of Related Art

There have been an increasing number of electrical appliances used in our daily life. The electrical appliances are each provided with a plug to connect to the electric power source, resulting in an insufficient number of the user's home outlet. Thus, an extension power strip is used cord to increase the number of outlets. Most conventional extension power strips are only designed for providing electric power, while not for providing the user the information about the electricity.

A conventional power control unit is configured in the external computer, it costs and it is not very convenient to control and monitor all the peripheral electronic devices.

A conventional plug having electric power and electrical energy display device is disclosed in the patent TWM263665. In the plug disclosed, the detecting circuit, the power measurement converting circuit, the direct-current power supply circuit, driving circuit, etc are all disposed inside the housing of the plug.

SUMMARY OF THE INVENTION

The embodiment of the instant disclosure provides a power strip. The power strip is adapted for receiving an alternating-current power and includes a plug, a main body, and a cord in connection between the plug and the main body. The plug has at least two conductive pins and an output device. The main body has at least one socket and a converting circuit. The cord includes an insulating cover, and an alternating-current transferring wire and a direct-current transferring wire, which are wrapped in the insulating cover. The alternating-current transferring wire is in electrical connection between the conductive pins and the socket. The direct-current transferring wire is in electrical connection between the output device and the converting circuit. The plug is for transferring the alternating-current power to the main body through the alternating-current transferring wire. The converting circuit is for converting the alternating-current power to a direct-current power and transferring the direct-current power to the output device through the direct-current transferring wire.

Another aspect of the instant disclosure provides a cord, which is adapted for a power strip having a plug and a main body. The cord is for connecting the plug and the main body. The cord compromises an insulating cover, an alternating-current transferring wire, and a direct-current transferring wire. The alternating-current transferring wire and the direct-current transferring wire are wrapped in the insulating cover. The cord has a first end and a second end, and the alternating-current transferring wire and the direct-current transferring wire are formed between the first end and the second end. The first end is for connecting to at least two conductive pins of the plug, and the second end is for connecting to the main body. Through the alternating-current transferring wire, an alternating-current power received by the conductive pins is transferred to the main body. Through the direct-current transferring wire, a direct-current signal generated by the main body is transferred to the plug.

These and other features and advantages of the present invention will be described in, or will become apparent to those of ordinary skill in the art in view of, the following detailed description of the exemplary embodiments of the present invention.

BRIEF DESCRIPTION OF THE DRAWINGS

The novel features believed characteristic of the invention are set forth in the appended claims. the invention itself, however, as well as a preferred mode of use, further objectives and advantages thereof, will best be understood by reference to the following detailed description of an illustrative embodiments when read in conjunction with the accompanying drawings, wherein:

DETAILED DESCRIPTION OF THE PREFERRED EMBODIMENTS

The instant disclosure will be described more specifically with reference to the following embodiments. It is to be noted that the following descriptions of preferred embodiments are provided herein for purpose of illustration and description. It is not intended to be exhaustive or limiting to the precise form disclosed.

First Embodiment

Figure 1:
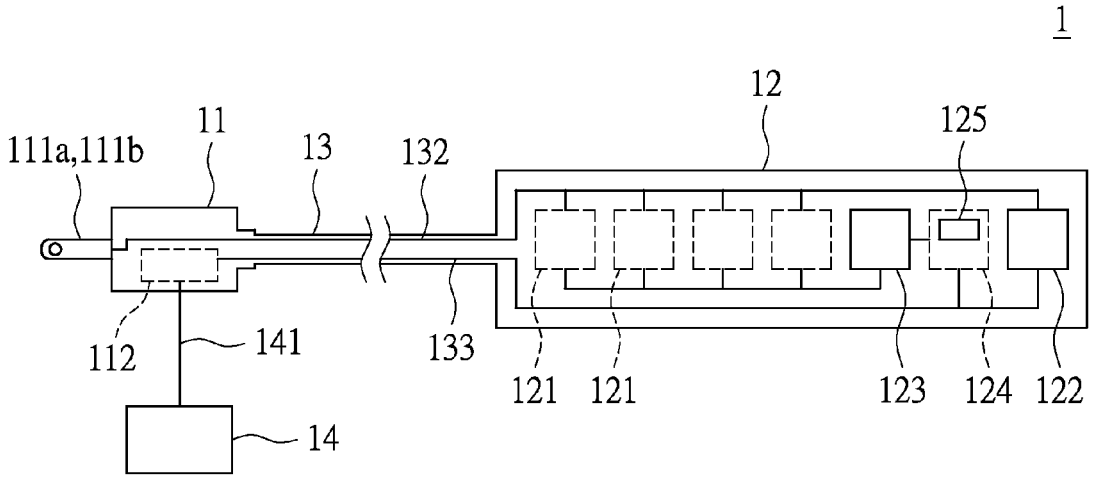
FIG. 1 illustrates a schematic circuit diagram of a power strip in accordance with a first embodiment of the instant disclosure.
Figure 2:
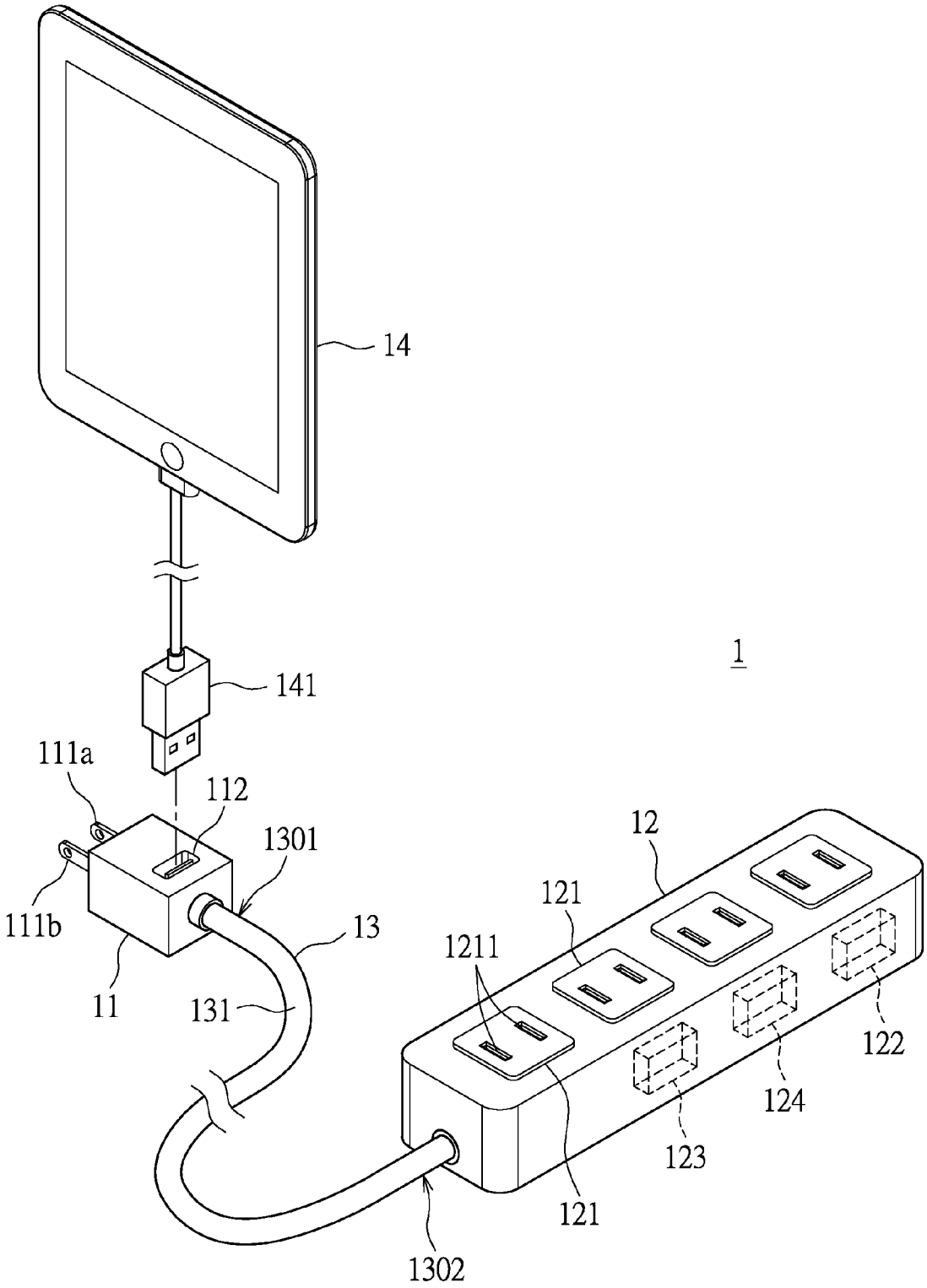
FIG. 2 illustrates a perspective view of the power strip in accordance with the first embodiment of the instant disclosure.
Figure 3:
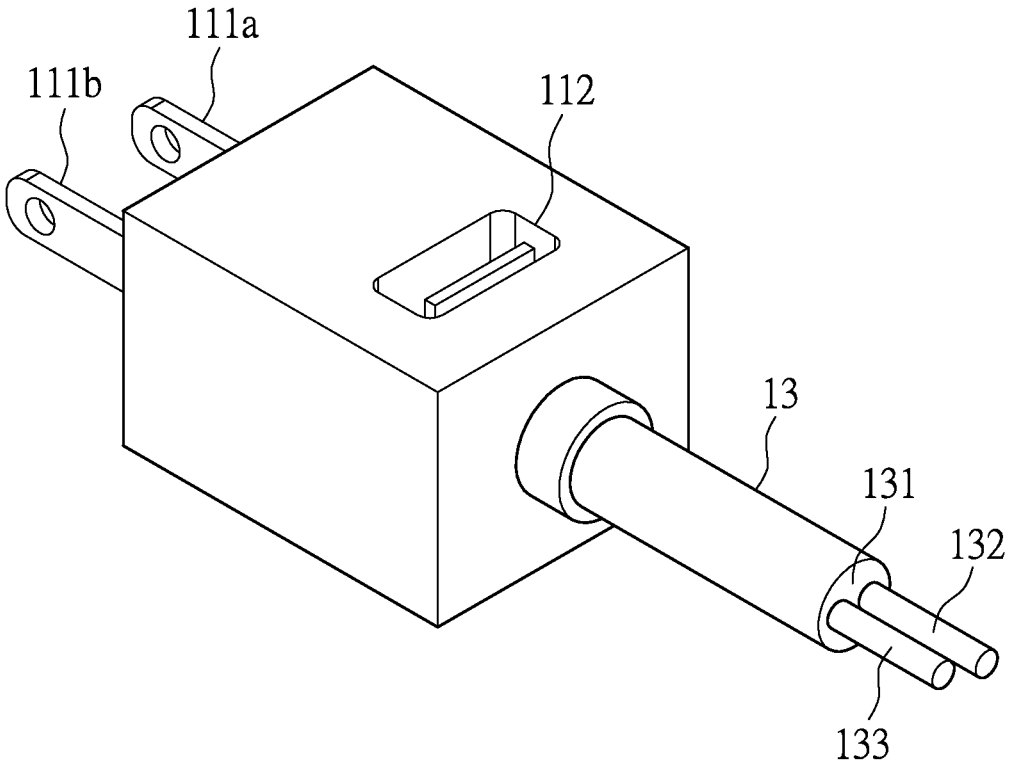
FIG. 3 illustrates a perspective view of a portion of the power strip in accordance with the first embodiment of the instant disclosure.

Please refer concurrently to FIG. 1, FIG. 2, and FIG. 3. FIG. 1 illustrates a schematic circuit diagram of a power strip in accordance with a first embodiment of the instant disclosure. FIG. 2 illustrates a perspective view of the power strip in accordance with the first embodiment of the instant disclosure. FIG. 3 illustrates a perspective view of a portion of the power strip in accordance with the first embodiment of the instant disclosure. The power strip 1 provided in the instant disclosure is adapted for receiving an alternating-current power (referred to as the AC power). The power strip 1 includes a plug 11, a main body 12, and a cord 13 in connection between the plug 11 and the main body 12, where the cord includes an insulating cover 131, an alternating-current transferring wire 132 (referred to as the AC transferring wire 132), and a direct-current transferring wire 133 (referred to as the DC transferring wire 133).

The AC transferring wire 132 and the DC transferring wire 133 both are wrapped in the insulating cover 131. In the instant disclosure, non-conducting coatings (not shown) can respectively be disposed on the surfaces of the AC transferring wire 132 and the DC transferring wire 133 for providing electrical insulation between the AC transferring wire 132 and the DC transferring wire 133. Alternatively, the AC transferring wire 132 and the DC transferring wire 133 each can be wrapped by an insulating cover layer (not shown), preventing the AC transferring wire 132 and the DC transferring wire 133 from being in direct contact with each other. Moreover, the AC transferring wire 132 and the DC transferring wire 133 can together be wrapped in the single-layered insulating cover 131 (as shown in FIG. 3), thereby cooperatively forming the cord 13. The insulating cover 131 can be formed with an electrically insulating material that is heat-proof and pliable, such as a material comprising thermoplastic polymers. The AC transferring wire 132 serves as a path for providing the AC power. The DC transferring wire 133 serves as a path for transferring a direct-current power (referred to as the DC power) or transferring a direct-current signal (referred to as the DC signal).

As shown in FIG. 2, the plug 11 is attached to a first end 1301 of the cord 13, and the plug 11 has two conductive pins 111*a*, and 111*b*, which are a live pin 111*a* and a neutral pin 111*b*. The conductive pins 111*a*, and 111*b* are allowed to be removably plugged into an AC power supply outlet, such as an in-wall socket. The plug 11, for example, can be a plug of a Chinese standard, a plug of an American standard, or a plug of an Australian standard. The conductive pins 111*a*, and 111*b* can be designed according to various standards, and the instant disclosure is not limited thereto.

The plug 11 further has an output device 112. In the instant disclosure, the output device 112 is an USB port (Universal Serial Bus port) and serves as an interface for transferring a DC power or a DC signal. Specifically, when providing a DC voltage, the output device 112 can serve as a power source for a detachable device (e.g. a cell phone) in electrically connection thereto.

The main body 121 has a plurality of sockets 121 and a converting circuit 122. Each of the sockets 121 has a pair of conductive terminals (not shown), such as a pair of conductive terminals for live and neutral contacts, disposed within the socket 121. The conductive terminals are each electrically connected to the AC transferring wire 132. In another embodiment, the sockets 121 each may have more than two conductive terminals, and the instant disclosure is not limited thereto. The socket 121 serves as an interface for transferring an AC power. Specifically, when the socket 121 is providing an AC voltage, a plug of an electronic device (not shown) can be selectively plugged into the apertures 1211 of the socket 121 for being in electrically connection with the conductive terminals, whereby the electronic device can be supplied with the AC power. The converting circuit 122 of the main body 12 is for converting an AC power into a DC power.

The main body 12 further includes a consumption detecting circuit 123 and a processing unit 124 coupled to the consumption detecting circuit 123. The consumption detecting circuit 123 is for detecting an electric power output from the socket 121. The processing unit 124 has a processing circuit 125 (FIG. 5) and is for generating a DC signal according to the data of the electric power output detected by the consumption detecting circuit 123. The DC signal, for example, provides the information about the electric power consumption, such as cumulative using time, cumulative abnormal state time, cumulative time of receiving AC power, short-term cumulative amount of electric energy consumed, long-term cumulative amount of electric energy consumed and cumulative cost.

As shown in FIG. 1, the AC transferring wire 132 is in electrically connection between the conductive pins 111*a*, 111*b* and each of the sockets 121, whereby the plug 11 can transfer an AC power to the sockets 121 of the main body 12 through the AC transferring wire 132. Moreover, the AC transferring wire 132 is in electrically connection between the conductive pins 111*a*, 111*b* and the converting circuit 122 of the main body 12, whereby an AC power can also be transferred to the converting circuit 122 through the AC transferring wire 132 and be converted to a DC power by the converting circuit 122.

In addition, the DC transferring wire 133 is in electrically connection between the converting circuit 122 and the output device 112, whereby a DC power can be provided by the converting circuit 122 and transferred to the output device 112 of the plug 11 through the DC transferring wire 133. Moreover, a DC signal generated by the processing unit 124, such as the DC signal that provides the information about the electric power consumption, can be transferred to the output device 112 through the DC transferring wire 133. It is worth mentioning that, the DC power supplied to the plug 11 through the DC transferring wire 133 can also be used for the operation of the output device 112 of the plug 11.

As shown in FIG. 2 in the instant disclosure, the output device 112, which can serve as an interface for outputting a DC power or as an interface for outputting a DC signal, is disposed at the first end 1301 of the cord 13, while the circuit structures (such as the converting circuit 122, the consumption detecting circuit 123, and the processing circuit 125) are all disposed at the second end 1302 of the cord 13. Therefore, the plug 11 attached to the first end 1301 of the cord 13 can have sufficient accommodating space to accommodate the output device 112. Thus, the power strip 1 can provide a DC power and/or output a DC signal at the first end 1301 through the output device 112 of the plug 11.

In the instant embodiment, the power strip 1 further comprises a detachable display module 14, which is coupled to the output device 112 through an USB port for receiving and displaying the information about the electric power consumption. As a specific example, the detachable display module 14 can be the display module of a tablet or the display module of a mobile phone.

Another aspect of the instant disclosure provides a cord 13, which is adapted for a power strip 1 having a plug 11 and a main body 12. The cord 13 is for connecting the plug 11 and the main body 12. The cord 13 includes an insulating cover 131, an AC transferring wire 132, and a DC transferring wire 133. The AC transferring wire 132 and the DC transferring wire 133 are wrapped in the insulating cover 131. The cord 13 has a first end 1301 and a second end 1302, and the AC transferring wire 131 and the DC transferring wire 133 are formed between the first end 1301 and the second end 1302. The first end 1301 is for connecting to at least two conductive pins 111*a*, 111*b* of the plug 11, and the second end 1302 is for connecting to the main body 12. The conductive pins 111*a*, 111*b* are for receiving an AC power and transferring the AC power to the main body 12 through the AC transferring wire 132, and the main body 13 is for generating a DC signal and transferring the DC signal to the plug 11 through the DC transferring wire.

Second Embodiment

Figure 4:
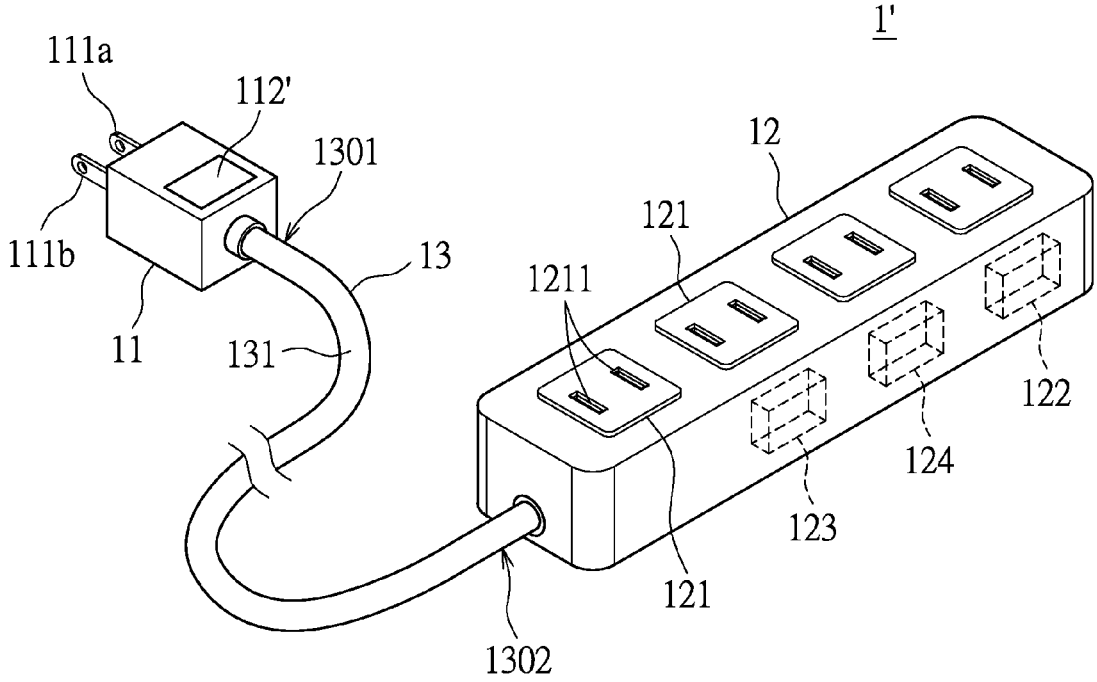
FIG. 4 illustrates a perspective view of the power strip in accordance with a second embodiment of the instant disclosure.

Please refer to FIG. 4, which illustrates a perspective view of the power strip in accordance with a second embodiment of the instant disclosure. The instant embodiment is similar to the aforementioned embodiment, and the description hereinafter further explains the difference there-between. While the similar features of the second embodiment are not further described.

In the instant disclosure, the output device 112' is a display module and includes, for example, a LCD. Thus, the power strip 1' can utilize the output device 112' to display the content of a DC signal, such as the DC signal that provides the information about the electric power consumption, transferred through the DC transferring wire 133. As a specific example, through the output device 112', the power strip 1' can display the information about the amount of the electric power output from the socket 121.

Third Embodiment

Figure 5:
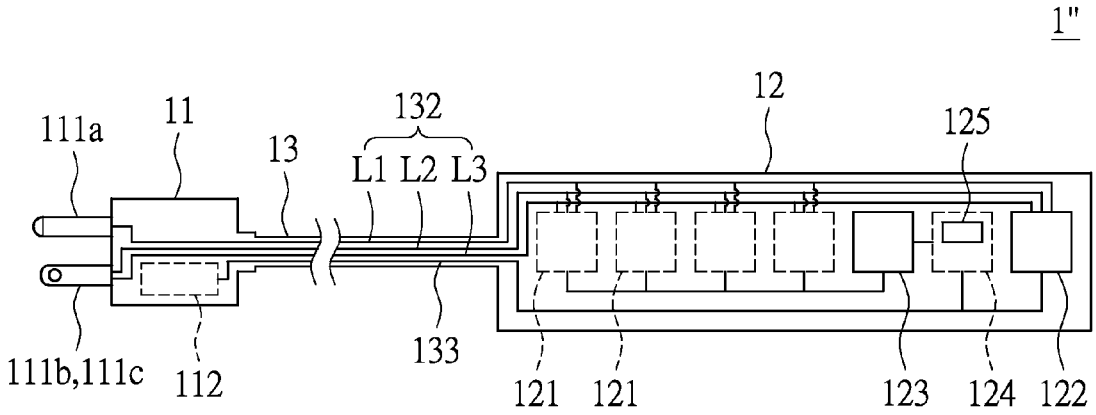
FIG. 5 illustrates a schematic circuit diagram of the power strip in accordance with a third embodiment of the instant disclosure.
Figure 6:
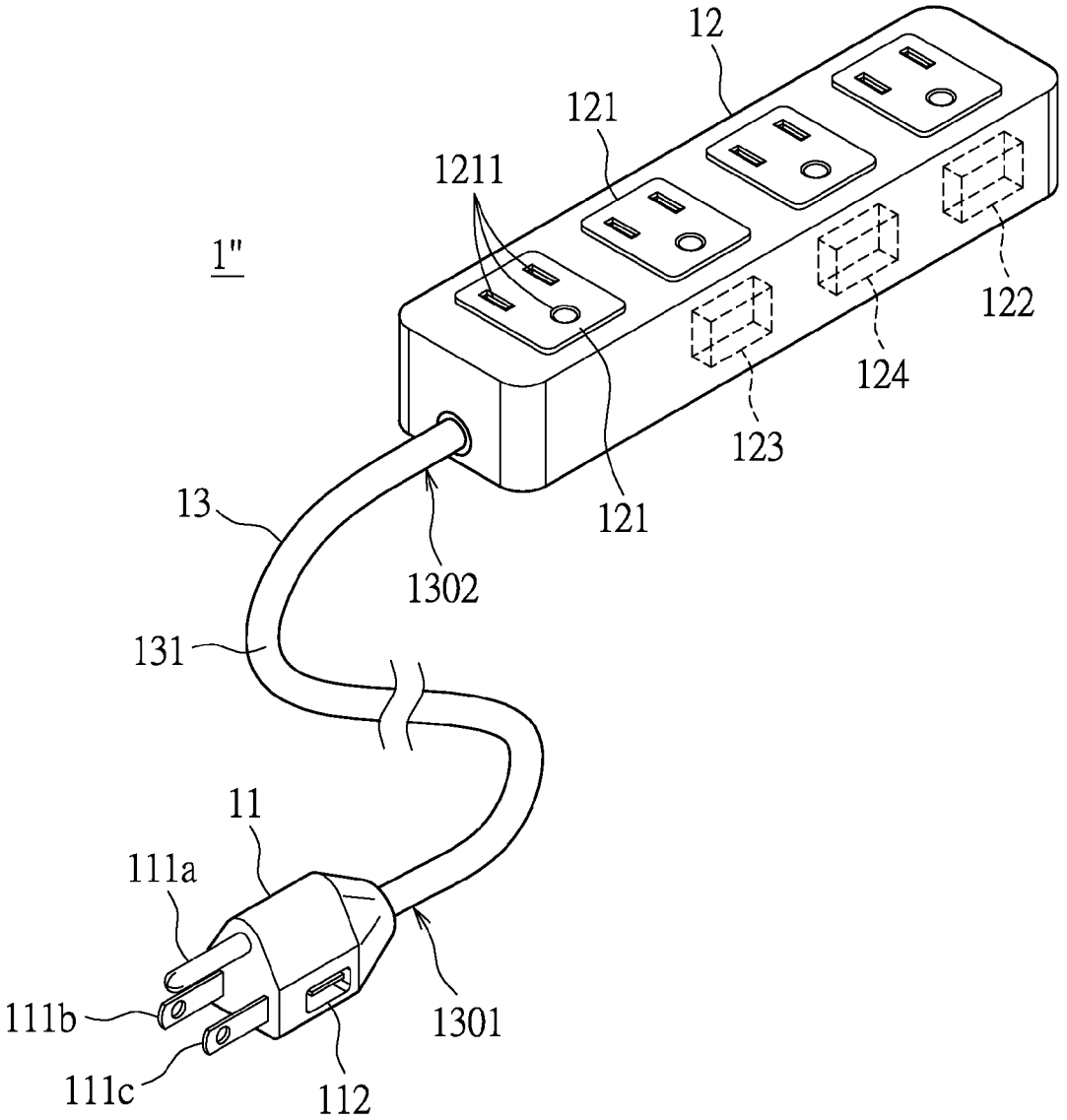
FIG. 6 illustrates a perspective view of the power strip in accordance with the third embodiment of the instant disclosure.

Please refer concurrently to FIG. 5, and FIG. 6. FIG. 5 illustrates a schematic circuit diagram of the power strip in accordance with a third embodiment of the instant disclosure. FIG. 6 illustrates a perspective view of the power strip in accordance with the third embodiment of the instant disclosure. The instant embodiment is similar to the aforementioned first embodiment, and the description hereinafter further explains the difference there-between. While the similar features of the third embodiment are not further described.

In the power strip 1" of the instant disclosure, the plug 11 has three conductive pins 111*a*, 111*b*, and 111*c*, which are a live pin 111*a*, a neutral pin 111*b*, and, an earthing pin 111*c*. The plug 11, for example, can be a plug of a British standard, and the instant disclosure is not limited thereto. Each of the sockets 121 of the main body 12 has three conductive terminals for live, neutral, and earthing contacts respectively.

In addition, the AC transferring wire 132 of the instant disclosure includes a live line L1, a neutral line L2, and an earthing line L3. The live line L1, the neutral line L2, and the earthing line L3 each are formed between the first end 1301 and the second end 1302. In the instant disclosure, non-conducting coatings (not shown) can respectively be disposed on the surfaces of the live line L1, the neutral line L2, and the earthing line L3, preventing the live line L1, the neutral line L2, the earthing line L3, and the DC transferring wire 133 from being in direct contact with one another, thus avoiding short circuit. Moreover, the live line L1, the neutral line L2, and the earthing line L3 can together be wrapped in an insulating layer, thereby cooperatively forming the AC transferring wire 132. The three conductive pins 111*a*, 111*b*, and 111*c* of the plug 11 are in electrical connection with the live line L1, the neutral line L2, and the earthing line L3 respectively. The three conductive terminals of each socket 121 are also in electrical connection with the live line L1, the neutral line L2, and the earthing line L3 respectively.

In summary of the above, the power strip 1, 1', and 1" of the present disclosure can utilize the AC transferring wire 132 of the cord 13 to transfer the AC power received by the plug 11 from the first end 1301 of the cord 13 to the second end 1302 of the cord 13, for providing power source for the sockets 121 and the circuits in the main body 12. The AC power transferred to the converting circuit 122 can be converted to a DC power. Furthermore, the power strip 1, 1', and 1" can utilize the DC transferring wire 133 of the cord 13 to transfer the DC power converted from the second end 1302 of the cord 13 to the first end 1301 of the cord 13, for providing DC power source to the plug 11. In an alternative embodiment, the power strip 1, 1', and 1" of the present disclosure can utilize DC transferring wire 133 of the cord 13 to transfer the DC signal generated by the circuit in the main body 12 from the second end 1302 of the cord 13 to the first end 1301 of the cord 13, whereby the DC signal can be output or displayed at the first end 1301 of the cord 13 through the output device 112, 112' of the plug 11.

While the invention has been disclosed with respect to a limited number of embodiments, numerous modifications and variations will be appreciated by those skilled in the art. It is intended, therefore, that the following claims cover all such modifications and variations that may fall within the true sprit and scope of the invention.

What is claimed is:

1. A power strip, adapted for receiving an alternating-current power, the power strip comprising:

a plug having at least two conductive pins and an output device;

a main body having at least one socket and a converting circuit; and a cord in connection between the plug and the main body, wherein the cord includes an insulating cover, an alternating-current transferring wire, and a direct-current transferring wire, the alternating-current transferring wire and the direct-current transferring wire are wrapped in the insulating cover, the alternating-current transferring wire is in electrically connection between the conductive pins and the at least one socket, and the direct-current transferring wire is in electrically connection between the converting circuit and the output device;

wherein the plug is for transferring the alternating-current power to the main body through the alternating-current transferring wire, and the converting circuit is for converting the alternating-current power to a direct-current power and providing the direct-current power to the output device through the direct-current transferring wire;

wherein the direct-current transferring wire has a first portion disposed inside the main body to electrically connect to the converting circuit, a second portion disposed inside the plug to electrically connect to the output device, and a third portion connected between the first portion and the second portion and disposed outside the main body and the plug.

2. The power strip of claim 1, wherein the main body further comprises:

a consumption detecting circuit for detecting an electric power output from the at least one socket; and a processing unit coupled to the consumption detecting circuit, wherein the processing unit is for transferring a signal, which provides the information about electric power consumption, to the output device through the direct-current transferring wire.

3. The power strip of claim 1, wherein the output device is an USB port or a display module.

4. The power strip of claim 1, further comprising a detachable display module, which is coupled to the output device through an USB port for receiving and displaying the information about electric power consumption.

5. A cord, adapted for a power strip having a plug and a main body, where the cord is for connecting the plug and the main body, the cord comprising:

an insulating cover;

an alternating-current transferring wire wrapped in the insulating cover and a direct-current transferring wire wrapped in the insulating cover;

wherein the cord has a first end and a second end, the alternating-current transferring wire and the direct-current transferring wire are formed between the first end and the second end, the first end is for connecting to at least two conductive pins of the plug, and the second end is for connecting to the main body, wherein the conductive pins are for receiving an alternating-current power and transferring the alternating-current power to the main body through the alternating-current transferring wire, and the main body is for generating a direct-current signal and transferring the direct-current signal to the plug through the direct-current transferring wire;

wherein the plug has at least two conductive pins and an output device;

wherein the direct-current transferring wire has a first portion disposed inside the main body to electrically connect to the converting circuit, a second portion disposed inside the plug to electrically connect to the output device, and a third portion connected between the first portion and the second portion and disposed outside the main body and the plug.

6. The cord of claim 5, wherein the main body comprises at least one socket and a converting circuit, the plug comprises the at least two conductive pins and an output device, the conductive pins are for transferring the alternating-current power to the at least one socket and the converting circuit through the alternating-current transferring wire, and the converting circuit is for converting the alternating-current power to a direct-current power and providing the direct-current power to the output device through the direct-current transferring wire.

7. The cord of claim 5, wherein the main body comprises a processing unit for detecting an electric power output from the at least one socket; and transferring a signal, which provides the information about an electric power consumption, to the first end through the direct-current transferring wire.

8. The cord of claim 5, wherein the alternating-current transferring wire includes a live line, a neutral line, and an earthing line, and the live line, the neutral line, and the earthing line are all wrapped in the insulating cover.

* * * * *